United States Patent [19]

Van Kanegan et al.

[11] Patent Number: 5,012,736

[45] Date of Patent: May 7, 1991

[54] SEALING ASSEMBLY FOR LIQUID FOUNTAIN

[75] Inventors: Eugene M. Van Kanegan, Elmhurst, Ill.; Wayne D. Klimek, Green Bay, Wis.

[73] Assignee: Paper Converting Machine Company, Green Bay, Wis.

[21] Appl. No.: 423,637

[22] Filed: Oct. 19, 1989

Related U.S. Application Data

[63] Continuation of Ser. No. 99,128, Sep. 21, 1987, abandoned.

[51] Int. Cl.[5] ..... B41F 31/02; B41F 31/06; B41L 27/08

[52] U.S. Cl. ..... 101/211; 101/207; 101/210

[58] Field of Search ..... 101/207, 208, 210, 363, 101/364, 366, 350, 483, 211, 148; 118/259, 407; 427/265, 285

[56] References Cited

U.S. PATENT DOCUMENTS

| | | | |
|---|---|---|---|
| 1,919,283 | 7/1933 | Troy | 101/210 |
| 3,032,007 | 5/1962 | McCauliff | 101/210 X |
| 3,701,335 | 10/1972 | Barnscheidt | 118/104 |
| 3,831,517 | 8/1974 | Wagner | 101/208 |
| 4,165,688 | 8/1979 | Leanna | 101/207 |
| 4,361,089 | 11/1982 | Wittkupf et al. | 101/207 X |
| 4,366,754 | 1/1983 | Sarda | 101/208 |
| 4,426,412 | 1/1984 | Geberg | 118/410 |
| 4,513,662 | 4/1985 | Schneider | 101/207 |
| 4,581,995 | 4/1986 | Stone | 101/366 |
| 4,667,595 | 5/1987 | Geretzki | 101/207 |
| 4,796,528 | 1/1989 | Sarazan | 101/208 |

FOREIGN PATENT DOCUMENTS 1263650 2/1972 United Kingdom .

*Primary Examiner*—J. Reed Fisher

*Attorney, Agent, or Firm*—Tilton, Fallon, Lungmus & Chestnut

[57] ABSTRACT

A sealing assembly for a liquid fountain such as is employed in flexographic printing and which is especially adapted for the split color printing wherein a foam layer separates the various ink compartments and is equipped with a liquid flow slot in the portion facing the liquid metering roll so as to provide limited axial flow of a slot liquid which is compatible with the ink in the various compartments.

4 Claims, 4 Drawing Sheets

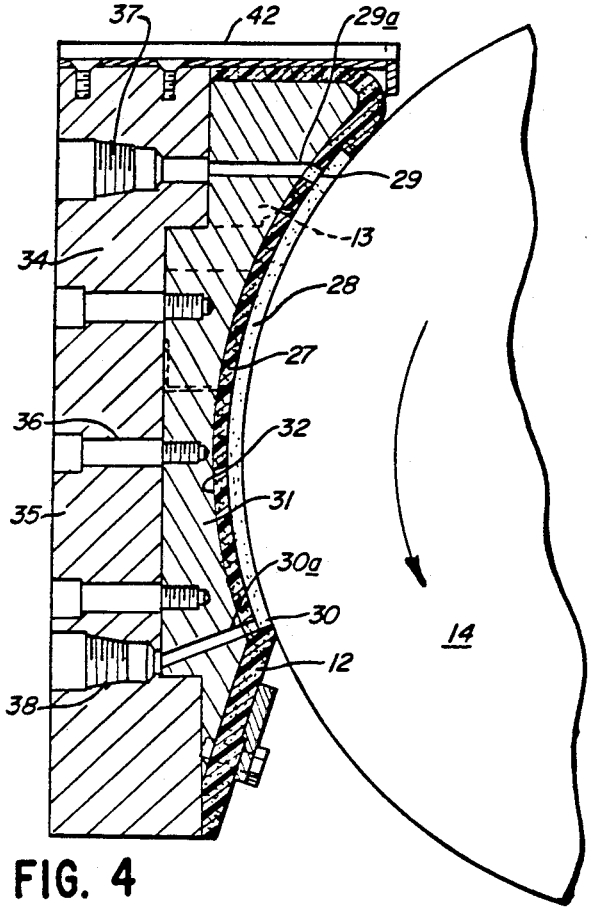
FIG. 4
FIG. 5
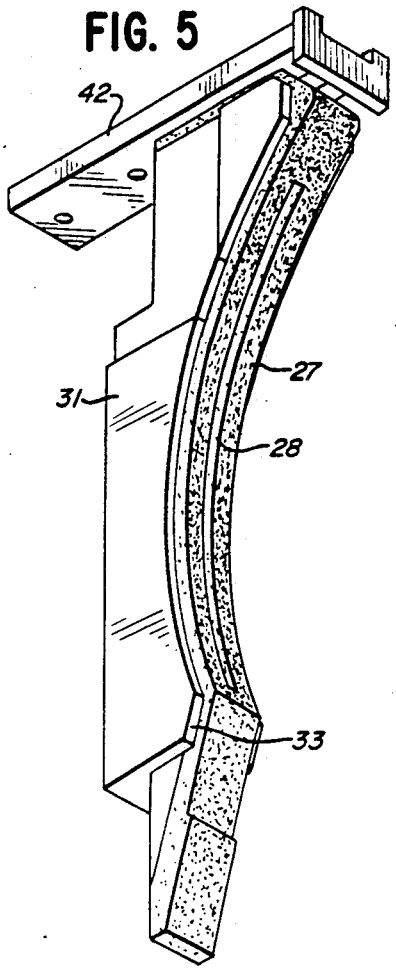
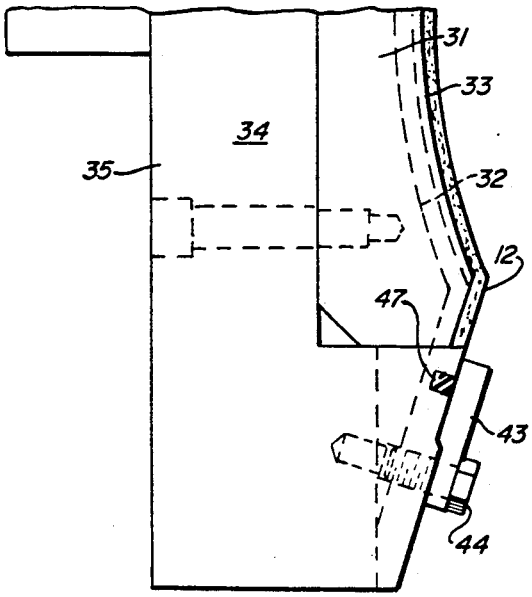
FIG. 6
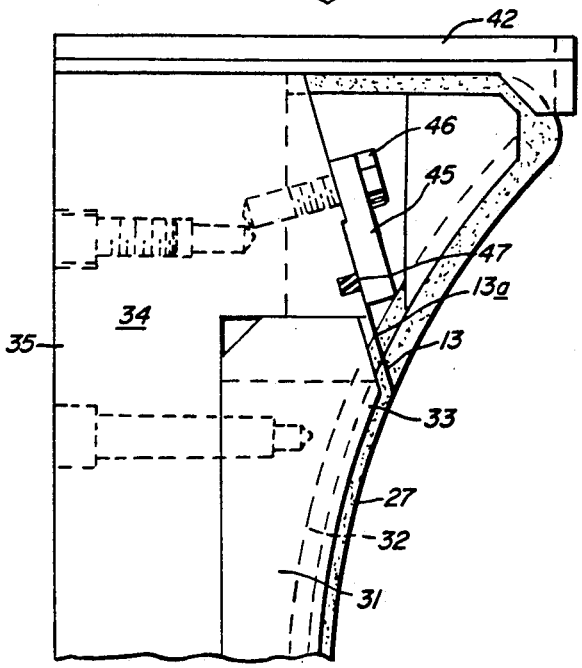
FIG. 7

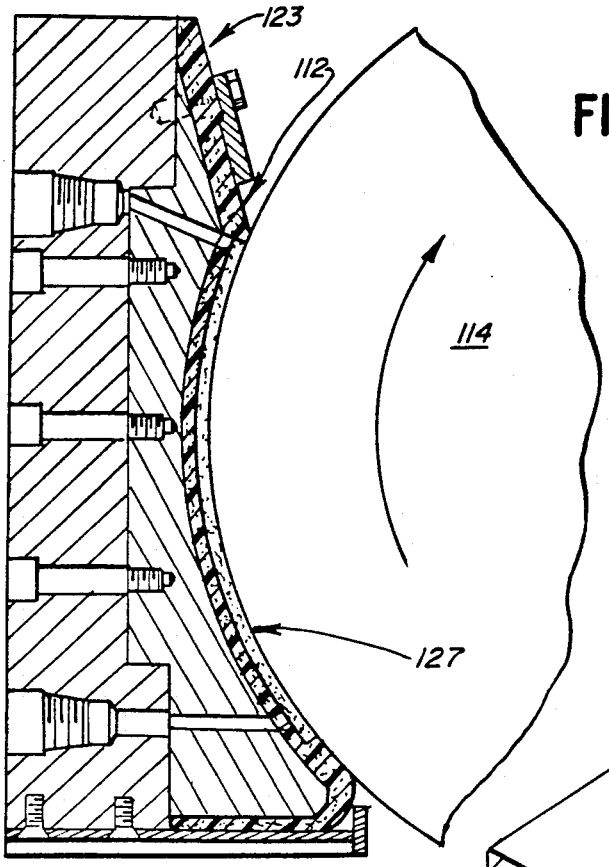
FIG. 8
FIG. 9
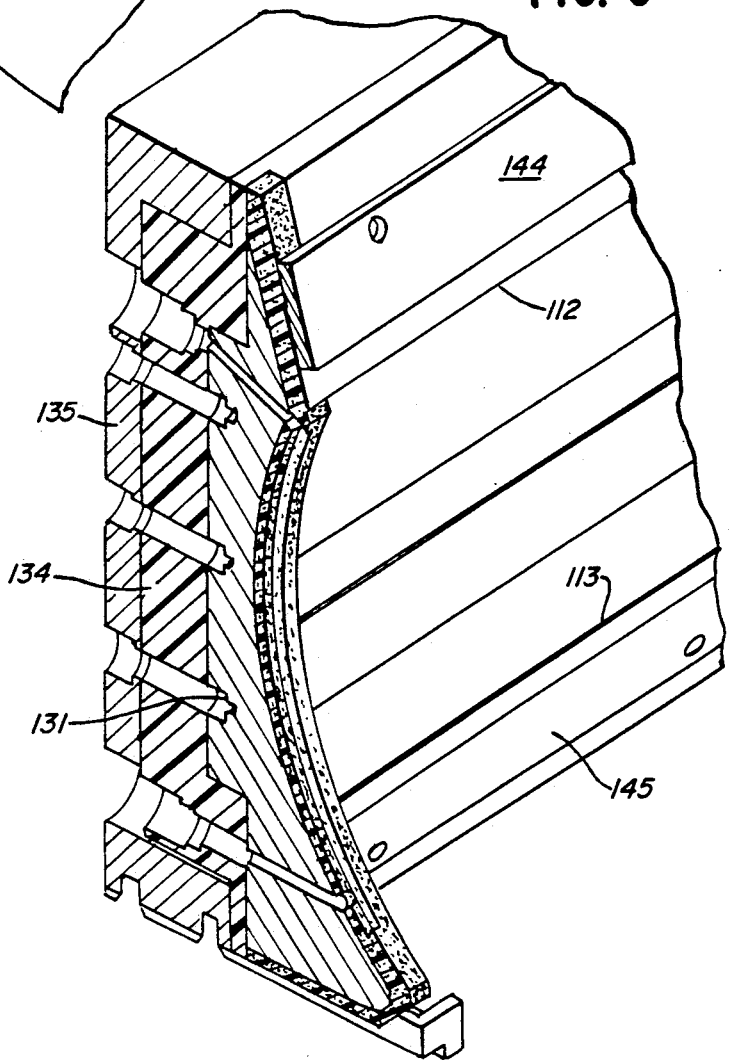

SEALING ASSEMBLY FOR LIQUID FOUNTAIN

The application is a continuation of application Ser. No. 099,128, filed Sept. 21, 1987, now abandoned.

BACKGROUND AND SUMMARY OF INVENTION

This invention relates to a sealing assembly for a liquid fountain and, more particularly, a sealing assembly especially adapted for use in a split fountain ink supply system for multi-color flexographic printing.

Although the invention is described in terms of flexographic printing, it will be appreciated that the sealing assembly can be used to advantage in related applications such as coaters, gravure printing, intaglio printing, etc. There has been, however, a pressing need for an effective seal to prevent mixing of two or more different color inks when applied side-by-side from the same fountain. Typical of recent patents illustrating sealing assemblies for split fountain operation are U.S. Pat. Nos. 4,165,685, 4,581,995 and 4,667,595.

According to the invention, a surprisingly advantageous sealing assembly is provided through the use of layer of resilient material such as foam elastomer adapted to abut the arcuate surface of a metering roll to define chambers holding liquid to be applied, viz., ink and wherein the material has a circumferentially extending slot at the surface of the metering roll to accommodate the flow of liquid under pressure. The liquid under pressure is employed in the illustrated embodiment to effect a seal between ink chambers and provide make-up solvent for the ink. This is not found in the art, particularly the above mentioned patents.

Other objects and advantages of the invention can be seen in the ensuing specification.

The invention is described in conjunction with the accompanying drawing, in which FIG. 1 is a schematic side elevational view of a typical flexographic printing assembly;

FIG. 4 is a fragmentary enlarged sectional view, as would be seen along the sight line 4—4 of FIG. 3;

FIG. 5 is a perspective view of the inventive seal assembly as seen in FIG. 4;

FIG. 6 is an enlarged fragmentary side view of the lower portion of the fountain featuring the scraping doctor blade;

FIG. 7 is an enlarged fragmentary side view of the upper portion of the fountain featuring the trailing doctor blade;

FIG. 8 is a view similar to FIG. 4 but with the fountain essentially inverted for opposite rotation of the liquid metering roll; and FIG. 9 is a perspective view of the seal assembly of FIG. 8 partially in section.

DETAILED DESCRIPTION

Figure 1:
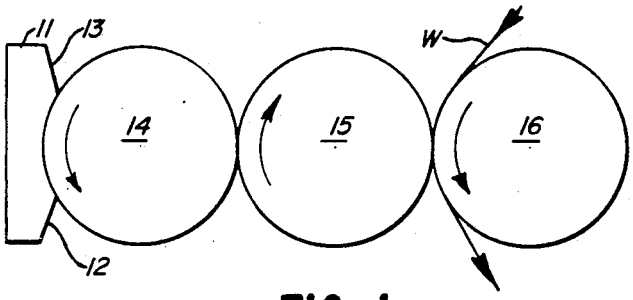

The basic arrangement for flexographic printing is well known and is illustrated schematically in FIG. 1 where the numeral 11 designates generally the ink fountain which contains ink. The fountain is equipped with a pair of doctor blades 12 and 13 which operate against a liquid metering/feed roll 14—often referred to as an "anilox" roll. Normally, this has a pattern of cells of variable depth.

In the arrangement illustrated in FIG. 1, the doctor blade 12 is the scraping or "cleaning" doctor—limiting the amount of ink to be picked up by the cells. The doctor blade 13 is a trailing or "wiping" blade doctor to limit the outflow ink in an undesired direction.

Ink from the cells of the roll 14 is transferred to a plate roll 15 and then to the web W which is partially wrapped on an impression cylinder 16. The fountain 11 is shown in FIGS. 2 and 3 in connection with an operational embodiment.

Figure 2:
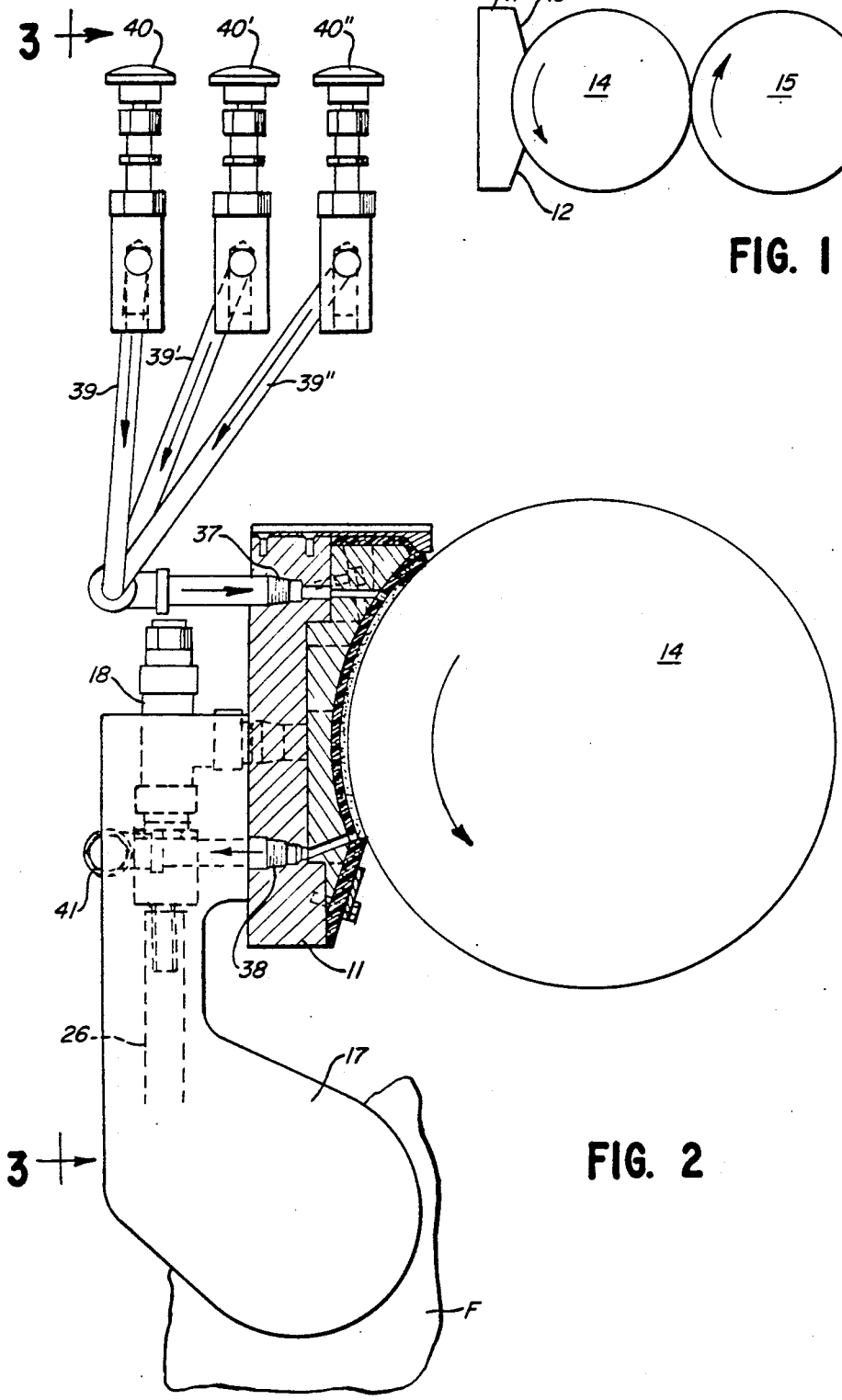
FIG. 2 is an enlarged detailed view of the left hand portion of FIG. 1.

Referring now to FIG. 2, a side elevational view of the fountain 11 is seen to be attached to a pivot arm 17. A pair of such arms are pivotally mounted on the machine frame F—shown only fragmentarily. It will be appreciated that the machine will incude the usual side frames for supporting the various rolls. However, details of the frame are conventional and are omitted here for clarity of picturization and ease of understanding.

Figure 3:
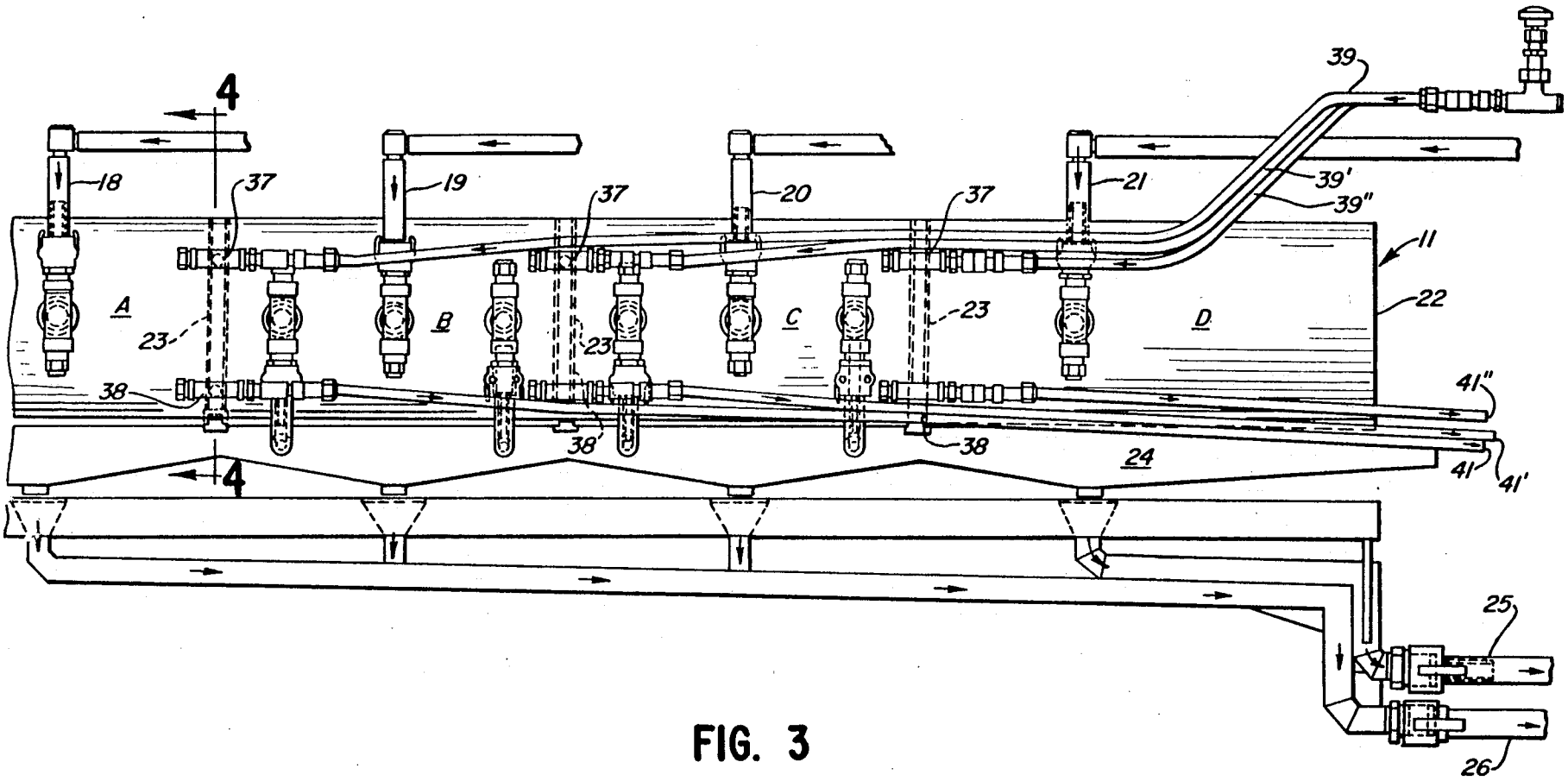
FIG. 3 is an end elevational view of the printing assembly of FIG. 2 such as would be seen along the sight line 3—3 of FIG. 2.

Inasmuch as the invention is concerned with chamber seals in the liquid supply fountain, reference is now made to FIG. 3 where the fountain 11 is set up for four color printing.

Ink supply lines are provided at 18, 19, 20 and 21 spaced along the length of the fountain 11. The fountain 11 is closed by end seals as at 22 which may advantageously be of the same construction as the intermediate sealing assemblies of the invention. Again, details of the end seals are omitted for ease of understanding.

Intermediate sealing assemblies 23 are also longitudinally spaced along the length of the fountain—the length of the fountain extending in a direction parallel to the axis of the anilox roll 14. Three sealing assemblies 23 are provided (in conjunction with the end seals) to develop four ink chambers A, B, C, D, one for each of the ink supply lines 18–21.

Ink drains as at 24 for the chamber D are provided on the frame connected to suitable piping as at 25 for the chamber D and 26 for the chamber A for recirculation of the inks. Again, this portion of the illustrated embodiment is conventional. We now refer to the sealing assemblies 23 which are identical and which will be explained in conjunction with FIGS. 4 and 5.

Sealing Assemblies—Foam Layer

One of the key features of the sealing assembly is a layer of resilient foam material 27 which is equipped with a circumferentially extending slot 28 in confronting relation with the anilox roll 14. The slot 28 is intended to accommodate the flow of liquid introduced through an opening 29 in the foam layer with most of the introduced slot liquid being removed through a second opening 30.

When the solvent for the metered liquid, viz., the inks, in the system is water, the liquid supplied to the slot 28 is also water. If the solvent is organic such as methyl ethyl ketone, that organic liquid will be the liquid supplied to the slot 28. Preferably, the liquid is supplied to the slot 28 through the opening 29 at a pressure incrementially greater than the pressure of ink in the chambers or compartments between the sealing assemblies 23. Also, the amount of liquid removed through the opening 30 is slightly less than that introduced through the opening 29 so that there is a slight axial flow of liquid out of the slot 28. Thus, there is some leakage of the seal liquid into the ink. This is especially advantageous because it not only creates a positive separation and prevents mixing of inks across the seal, but also aids in providing a portion of the makeup solvent to compensate for evaporation.

A further advantage is that the continual but minor flow of liquid axially against the surface of the anilox roll serves to minimize dry-up of any ink which may seep or spray onto the anilox roll surface in the portion thereof passing under the sealing assembly. This could be especially disadvantageous (the drying of ink in the anilox cells) when the seals might later be removed and printing is required where seals had been located.

One particular useful application of the invention is in connection with the printing of newspapers which very often run four colors but on occasion will run "double truck" two-page wide sheets. This requires replacement of the four chamber fountain with one having two chambers. Therefore, printing ink will be derived from those portions of the anilox roll previously confronting two of the seal assemblies 23. Another advantage of the inventive seal assembly is minimal wear on the cells so that the modified printing arrangement can be accomplished with the same anilox roll.

The foam layer or pad 27 is advantageously constructed of 0.25" thick polyethylene having an axial dimension of 0.52". A specific form is closed-cell cross linked polyethylene foam VOLARA® type A available from Stephenson & Lawyer, Inc. of Grand Rapids, Mich. The slot 28 is positioned centrally of the width of the pad 27 and is ⅛" wide and 0.12" deep. The pad 27 is equipped with a pressure sensitive adhesive on the side opposite that equipped with the slot 28.

Sealing Assembly—Support

A support 31 is provided for the pad 27. More particularly, the support 31 has an arcuately extending confronting portion 32 which receives the pressure sensitive adhesive-equipped face of the pad 27. Additionally, the support 31 is equipped with flanges as at 33 (see FIG. 5) which flank the sides of the pad 27. For example, in the illustration given, the flange height is of the order of 0.12"—measured radially of the anilox roll 14—so that the 0.25" thick foam layer protrudes beyond the side flanges 33. The flanges 33, therefore, support the foam layer or pad 27 against axial shift.

The support 31 is equipped with a flow passage **29*a* (see the upper portion of FIG. 4) which communicates with the liquid inlet port 29 of the foam layer 27. In similar fashion, the lower portion of FIG. 4 illustrates a flow passage 30*a* which communicates with the liquid outlet port or opening 30 in the foam layer 27**.

Sealing Assembly—Bracket and Liner

The support 31 in turn is carried by a complementarily shaped plastic liner 34 and which in turn is carried by a metal bracket 35—still referring to FIG. 4. The support 31 is removably fixed on the liner 34 and bracket 35 by a plurality of countersunk cap screws 36. Additionally, the liner 34 and bracket 35 are equipped with flow passages at 37 for inlet liquid and at 38 for seal waste liquid. These communicate with the passages **29*a*, 29 and 30*a*, 30, respectively. These flow passages 37 and 38 are also designated in FIG. 3 relative to the three intermediate sealing assemblies 23**.

In the upper right hand portion of FIG. 3 it will be seen that a supply line 39 is provided to deliver seal liquid to the left-most seal assembly 23—the assembly that cooperates with an end seal to define the chamber A. Similar lines as at 39' and 39'' provide seal liquid to the other two assemblies. Each is controlled by a manual needle valve as at 40, 40' and 40''—see also the upper left hand portion of FIG. 3. Also provided are liquid waste lines 41, 41', 41'' for each assembly see also the right hand portion of FIG. 3.

Referring to FIGS. 4 and 7, it will be seen that the bracket 35 is equipped with a removable clamping plate 42 at the upper end thereof for the purpose of securing the upper end of the foam layer 27. The lower end is effectively clamped by the scraping doctor blade 12 as seen in FIGS. 4 and 6.

Doctor Blade Mounting

The liner 34 also provides the means for supporting the doctor blades 12 and 13. Referring to FIG. 6, it will be seen that the scraping doctor blade 12 is secured by a block 43 which in turn is secured to the liner by bolts 44.

The trailing doctor blade 13 can be seen in FIG. 7 and is clamped by blocks 45 and bolts 46 to the liner 34. In each of FIGS. 6 and 7 a seal 47 is provided for the doctor blade. The trailing doctor blade 13 extends only between seal assemblies as can be appreciated from the upper part of FIG. 4 where it is hidden by the pad 27. Each doctor blade 13 has a plurality of holes spaced along its length to permit gravity flow into its associated chamber. It will be appreciated that ink can accumulate above this trailing doctor blade from the various cells in the anilox roll 14.

Reverse Rotation

The inventive arrangement can be adapted for reverse rotation as illustrated in FIG. 8. There, like numerals are used to those in FIG. 4 but with the addition of 100. In FIG. 8, the numeral 114 designates the anilox roll which is now seen to be rotating in a clockwise direction. For this purpose, the sealing assembly 23 has been inverted and is now designated 123. This can be seen in FIG. 9, the scraping doctor blade designated 112 is at the upper end of the foam layer 127 and the trailing doctor blade 113 is adjacent the lower end.

The support is designated 131, the liner 134 and the bracket 135 These all function as described previously.

As seen in FIG. 9, the scraping doctor blade 112 extends full length of the roll 114 while the trailing doctor blade 113 extends only in segments between the various supports 31. In the embodiment of FIGS. 4 and 5, the segmental wiping doctor blades 13 are equipped with axially spaced holes as at **13*a* to permit ink flow therethrough should an accumulation occur above the trailing blade. However, such openings are not provided in the trailing doctor blade 113 of the embodiment of FIGS. 8 and 9**—to do so would allow metering liquid to escape from the fountain.

Operation

In the operation of the invention and using water as the liquid solvent, for example, seal water is supplied through lines 39, 39', 39'' for the various sealing assemblies 23 with a portion being removed from each via lines 41, 41' and 41''. The amount of seal liquid is controlled by the valves 40, 40', 40'' —see the upper left hand portion of FIG. 2.

Ink supply line 18 provides ink to chamber A between its associated end seal and the left seal assembly 23 and, in like fashion, the ink supply lines 19, 20 and 21 supply ink to chambers B, C and D. With the inventive arrangement there is a positive separation of inks in the various chambers, i.e., no mixing of different color inks. Further, there is no deterioration of ink characteristics because the seal does not degrade or damage the ink in any way which is not readily and easily correctable. The inventive arrangement does not suffer from the drawback of introducing air into the ink which is not acceptable because it causes foaming, nor does it introduce dirt or wear particles into the ink.

The inventive arrangement has performed acceptably up to 2000 feet per minute as measured on the surface of the anilox roll and for at least 8 hours continuous operation. Significantly, the seal width is about ½" so that less of the anilox roll is utilized.

The sealing liquid effectively lubricates the contact area between the seal and the anilox roll and keeps abrasive ink out of this area and the foam material is quite soft, creating a very gentle "footprint" against the surface of the anilox roll in contrast to the heavier imaging provided by prior art sealing assemblies.

In the illustration given, the water entering the ink was only about 0.3 to 0.6 quarts/hour/seal which is less than the amount of water to be added to the ink through the ink viscosity control system to compensate for solvent loss by evaporation during operation. The 0.6 quarts/hour/seal provides approximately ⅓ of the make-up solvent anticipated for newspaper printing. We have found that when the make-up water falls below about 0.3 quarts/hour/seal, the sealing is less effective.

While in the foregoing specification a detailed description of an embodiment of the invention has been set down for the purpose of illustration, many variations in the details hereingiven may be made by those skilled in the art without departing from the spirit and scope of the invention.

We claim:

1. A method of operating a split color fountain printing press comprising providing an anilox roll having cells and equipped with a fountain having circumferentially extending divider means therein providing at least two ink-holding chambers for drying type inks of different color but with a common liquid solvent wherein the anilox roll closes each chamber and is in contact with the ink held in each chamber, introducing ink into each chamber and continuously introducing air-free compatible liquid solvent through said divider means at the contact are between said divider means and said anilox roll for axial flow from said contact area toward and into both of said chambers to effect a seal between said chambers, to provide make-up solvent for said ink and to prevent dry-up of ink in the cells of said anilox roll.

2. The method of claim 1 in which said divider means is equipped with a circumferentially extending slot for introducing said liquid solvent.

3. The method of claim 2 in which said divider means is equipped with a liquid flow port adjacent each end and in which said liquid solvent is introduced through one port and slightly less liquid solvent is withdrawn from the other port.

4. The method of claim 1 in which said liquid solvent is water.

* * * * *